US008490849B2

(12) United States Patent
Liao

(10) Patent No.: US 8,490,849 B2
(45) Date of Patent: Jul. 23, 2013

(54) ANTI-SLIP ASSEMBLY FOR A STAPLE GUN

(75) Inventor: Min-Ho Liao, Taichung (TW)

(73) Assignee: Testo Industry Corp., Taichung (TW)

( * ) Notice: Subject to any disclaimer, the term of this patent is extended or adjusted under 35 U.S.C. 154(b) by 293 days.

(21) Appl. No.: 13/102,561

(22) Filed: May 6, 2011

(65) Prior Publication Data

US 2012/0280015 A1 Nov. 8, 2012

(51) Int. Cl.
*B25C 7/00* (2006.01)
*B25C 5/00* (2006.01)

(52) U.S. Cl.
USPC ..... 227/119; 227/120; 227/139

(58) Field of Classification Search
USPC ..... 227/119, 120, 127, 128, 139
See application file for complete search history.

(56) References Cited

U.S. PATENT DOCUMENTS

| | | | | |
|---|---|---|---|---|
| 4,442,965 | A * | 4/1984 | Leistner | 227/136 |
| 6,994,240 | B2 * | 2/2006 | Jakob et al. | 227/8 |
| 7,028,875 | B1 * | 4/2006 | Beville et al. | 227/8 |
| 2008/0093410 | A1 * | 4/2008 | Canlas et al. | 227/125 |

* cited by examiner

*Primary Examiner* — M. Alexandra Elve
*Assistant Examiner* — Andrew M Tecco
(74) *Attorney, Agent, or Firm* — Hershkovitz & Associates, PLLC; Abraham Hershkovitz

(57) ABSTRACT

An anti-slip assembly for a staple gun has a mounting device, an operating device and a limiting device. The mounting device is formed in the staple gun and has a mounting recess, a positioning recess, a pivotal recess and a through hole. The operating device is movably connected to the mounting device and has an anti-slip arm and an operating cap. The anti-slip arm is rotatably mounted in the mounting recess and has a mounting rod, a spring, a pivotal rod and an abutting stem. The operating cap is movably mounted in the mounting recess, is mounted around the anti-slip arm and has a releasing recess, a pressing recess, a pushing protrusion and at least one holding flange. The limiting device is detachably connected to mounting device and the staple gun and has a limiting frame and a limiting panel.

4 Claims, 5 Drawing Sheets

ANTI-SLIP ASSEMBLY FOR A STAPLE GUN

BACKGROUND OF THE INVENTION

1. Field of the Invention

The present invention relates to an anti-slip assembly, and more particularly relates to an anti-slip assembly for a staple gun that can hold the staples of the staple gun securely when the staple gun is in use, can operate conveniently and can provide a preferred quality of construction to the staple gun.

2. Description of Related Art

Conventional staple guns are used extensively with decorations, shoemaking and leatherwear and shoot staples into objects. A conventional staple gun has a firing pin mounted in a body of the conventional staple gun to impact the staple mounted in a staple magazine of the conventional staple gun to eject out of a muzzle of the conventional staple gun.

However, the firing pin of the conventional staple gun can be moved fleetly and continuously to impact the staples to eject out of the conventional staple gun, the staples mounted below the ejecting staple may be moved downwardly relative to the staple magazine by the vibration force and the reacting force provided by the firing pin and the ejecting staple. Although an elastic panel mounted in the staple magazine can push the staples to upwardly return to the original position, the moved staples may misalign with the firing pin and the firing pin cannot impact the staples accurately to eject and cannot provide a preferred quality of construction to the conventional staple gun.

To overcome the shortcomings, the present invention provides an anti-slip assembly for a staple gun to mitigate or obviate the aforementioned problems.

SUMMARY OF THE INVENTION

The main objective of the present invention is to provide an anti-slip assembly for a staple gun that can hold the staples of the staple gun securely when the staple gun is used, can operate conveniently and can provide a preferred quality of construction to the staple gun.

The anti-slip assembly for a staple gun in accordance with the present invention has a mounting device, an operating device and a limiting device. The mounting device is formed in a sidewall of the staple gun adjacent to a muzzle and has a mounting recess, a positioning recess, a pivotal recess and a through hole. The operating device is movably connected to the mounting device and has an anti-slip arm and an operating cap. The anti-slip arm is rotatably mounted in the mounting recess and has a mounting rod, a spring, a pivotal rod and an abutting stem. The operating cap is movably mounted in the mounting recess, is mounted around the anti-slip arm and has a releasing recess, a pressing recess, a pushing protrusion and at least one holding flange. The limiting device is detachably connected to mounting device and the staple gun and has a limiting frame and a limiting panel. The limiting frame is mounted securely on the staple gun, is securely connected to the mounting device and extends into the mounting recess. The limiting panel is detachably mounted on the staple gun to hold the operating cap securely with the anti-slip arm.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
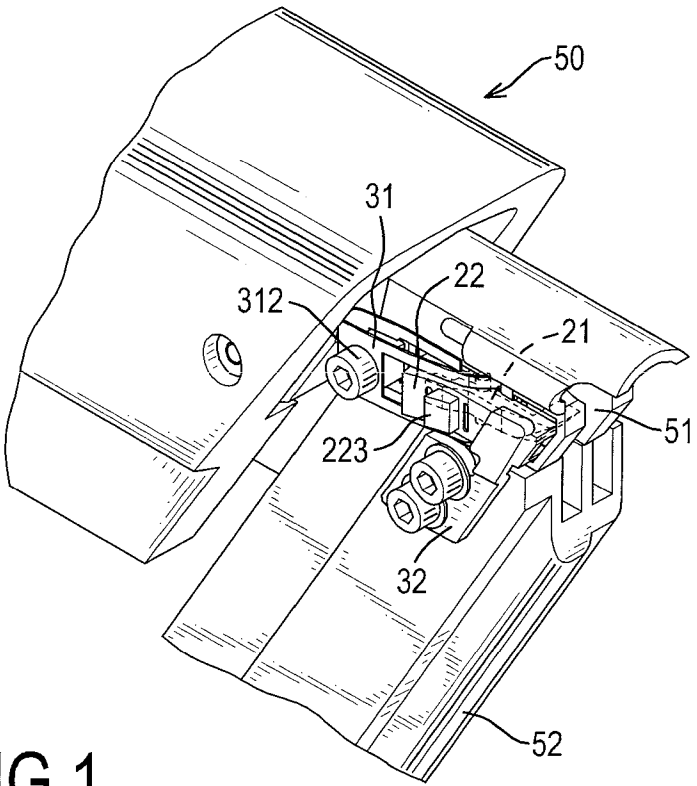
FIG. 1 is a perspective view of an anti-slip assembly for a staple gun in accordance with the present invention mounted on a staple gun.
Figure 2:
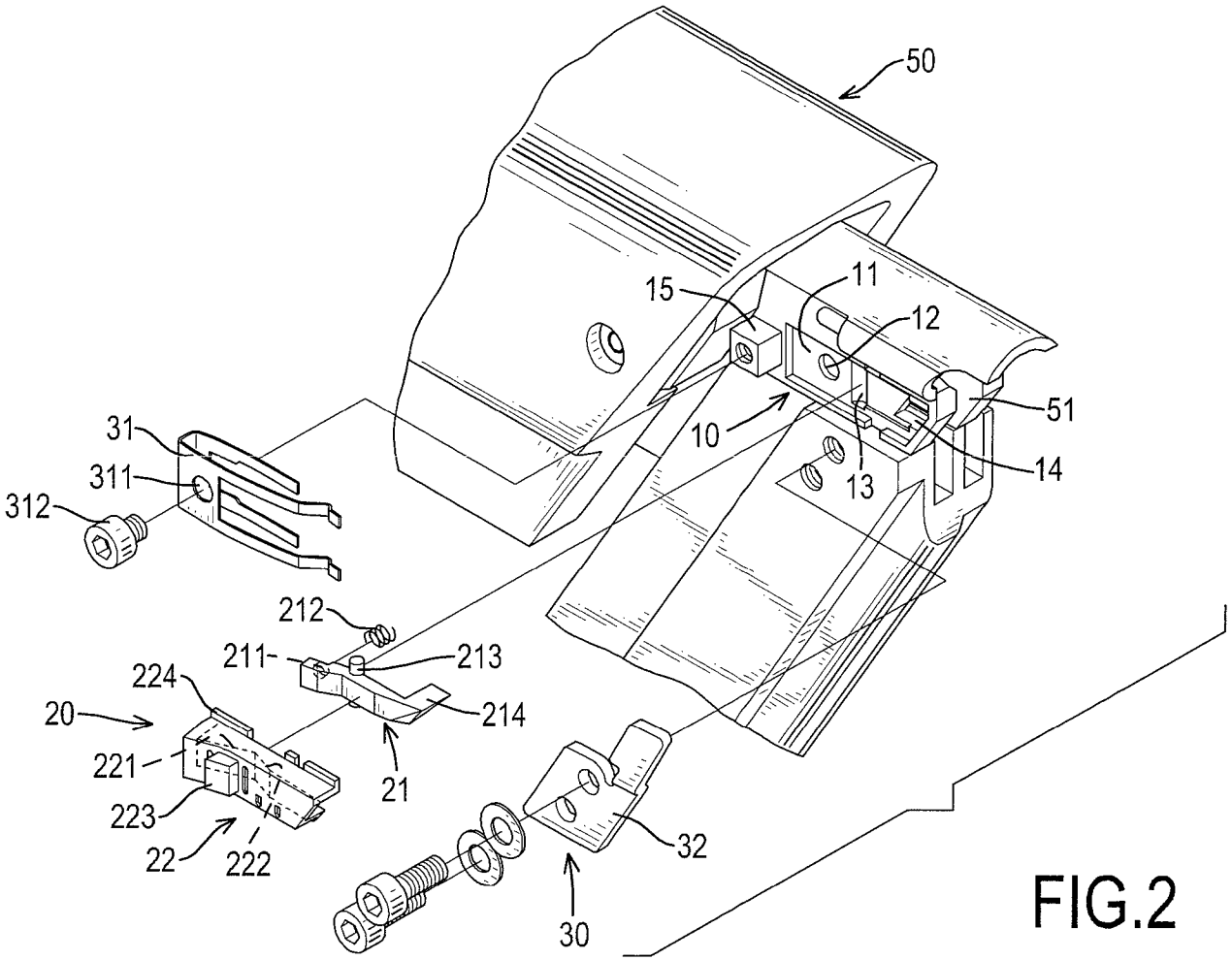
FIG. 2 is an exploded perspective view of the anti-slip assembly in FIG. 1.

With reference to FIGS. 1 and 2, an anti-slip assembly in accordance with the present invention is mounted on a staple gun 50 and comprises a mounting device 10, an operating device 20 and a limiting device 30.

Figure 3:
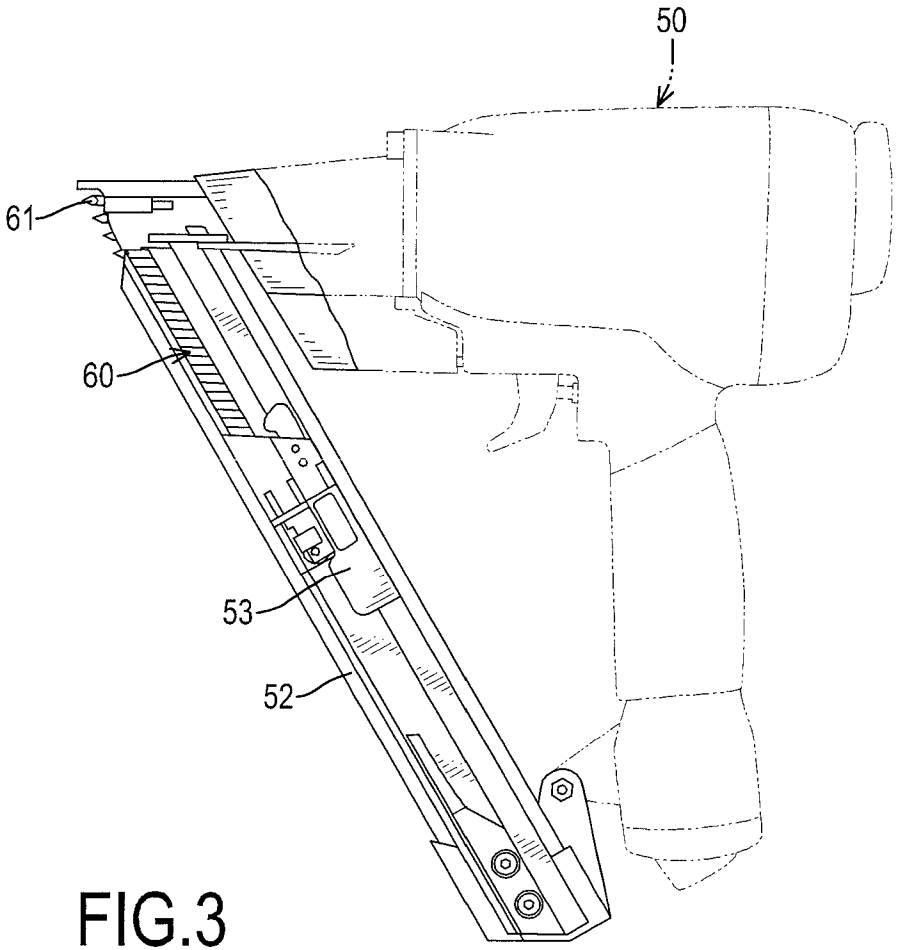
FIG. 3 is an operational side view of the staple gun with the anti-slip assembly in FIG. 1.

With further reference to FIG. 3, the staple gun 50 has a gun shaped body and a staple magazine 52. The gun shaped body has a front end, a bottom end, a sidewall and a muzzle 51. The muzzle 51 is formed in the front end of the gun shaped body of the staple gun 50. The staple magazine 52 is obliquely connected to the top end and the bottom end of the body and has a chamber and a pushing frame 53. The chamber is formed in the staple magazine 52, communicates with the muzzle 51 of the body and stores a staple row 60 inside. The pushing frame 53 is slidably mounted in the chamber of the staple magazine 52 to push the staples 61 of the staple row 60 moving upwardly to the muzzle 51 of the body of the staple gun.

The mounting device 10 is formed in the sidewall of the body of the staple gun 50 adjacent to the muzzle 51 and has a mounting recess 11, a positioning recess 12, a pivotal recess 13, a through hole 14 and a mounting protrusion 15. The mounting recess 11 may be rectangular, is formed in the sidewall of the body of the staple gun 50 and has a bottom surface, a front end and a rear end. The positioning recess 12 is formed in the bottom surface of the mounting recess 11 near the rear end of the mounting recess 11 and has a bottom surface. The pivotal recess 13 may be semi-cylindrical, is formed in the bottom surface of the mounting recess 11 between the positioning recess 12 and the front end of the mounting recess 11. The through hole 14 is formed through the bottom surface of the mounting recess 11 and the sidewall of the body of the staple gun 50 and communicates with the muzzle 51 of the staple gun 50. The mounting protrusion 15 is formed on and protrudes from the sidewall of the body of the staple gun 50 adjacent to the rear end of the mounting recess 11.

The operating device 20 is movably connected to the mounting device 10 and has an anti-slip arm 21 and an operating cap 22. The anti-slip arm 21 is pivotally mounted in the mounting recess 11 of the mounting device 10 and has a front end, a middle, a rear end, an internal surface, an external surface, a mounting rod 211, a spring 212, a pivotal rod 213 and an abutting stem 214. The internal surface of the anti-slip arm 21 faces the mounting recess 11 of the mounting device 10. The mounting rod 211 is formed on and protrudes from the internal surface of the anti-slip arm 21 near the rear end of the anti-slip arm 21 and faces the positioning recess 12 of the mounting device 10. The spring 212 is mounted around the mounting rod 211, is mounted in the positioning recess 12 and abuts the internal surface of the anti-slip arm 21 and the bottom surface of the positioning recess 12. The pivotal rod 213 is formed on and protrudes from the internal surface of the anti-slip arm 21 near the middle of the anti-slip arm 21 and is mounted in the pivotal recess 13 of the mounting device 10. The abutting stem 214 is formed on and protrudes from the internal surface of the anti-slip arm 21 at the front end of the anti-slip arm 21 and extends through the through hole 14 of the device 10. Preferably, the abutting stem 214 of the anti-slip arm 21 can extend into the muzzle 51 of the staple gun 50 via the through hole 14 of the mounting device 10.

The operating cap 22 is movably mounted in the mounting recess 11 of the mounting device 10, is mounted around the anti-slip arm 21 and has an open front side, a closed rear side, an open inner side, a closed outer side, a releasing recess 221, a pressing recess 222, a pushing protrusion 223 and at least one holding flange 224. The operating cap 22 is mounted around the anti-slip arm 21 via the open inner side and the open front side of the operating cap 22. The abutting stem 214 of the anti-slip arm 21 extends out of the operating cap 22 via the open front side of the operating cap 22. The releasing recess 221 is formed in the operating cap 22 near the closed rear side of the operating cap 22, communicates with the open inner side of the operating cap 22, is selectively mounted around the rear end of the anti-slip arm 21 and has a depth. The pressing recess 222 is formed in the operating cap 22, communicates with the releasing recess 221 and the open inner side of the operating cap 22 and selectively abuts the external surface of the anti-slip arm 21 near the pivotal rod 213 or the rear end of the anti-slip arm 21 and has a depth. The depth of the releasing recess 221 is deeper than the depth of the pressing recess 222. The pushing protrusion 223 is formed on and protrudes from the closed outer side of the operating cap 22 near the closed rear side of the operating cap 22. The at least one holding flange 224 is formed around the open inner side of the operating cap 22 and abuts the bottom surface of the mounting recess 11 of the mounting device 10.

The limiting device 30 is detachably connected to mounting device 10 and the staple gun 50 and has a limiting frame 31 and a limiting panel 32. The limiting frame 31 is U-shaped, is mounted securely on the sidewall of the body of the staple gun 50, is securely connected to the mounting protrusion 15 and extends into the mounting recess 11 of the mounting device 10 and has two rear ends, two front ends, a middle, a mounting hole 311, a fastener 312 and two holding tabs. The rear ends of the limiting frame 31 abut on the sidewall of the body of the staple gun 50 beside the mounting recess 11. The front ends of the limiting frame 31 extend into the mounting recess 11 beside the positioning recess 12. The mounting hole 311 is formed through the middle of the limiting frame 31 and aligns with the mounting protrusion 15. The fastener 312 is mounted in the mounting hole 311 of the limiting frame 31 and is screwed into the mounting protrusion 15 to hold the limiting frame 31 on the sidewall of the body of the staple gun 50. The holding tabs are respectively formed on the front ends of the limiting frame 31 and abut the at least one flange 224 of the operating cap 22 to hold the operating cap 22 slidably mounted in the mounting recess 11 of the mounting device 10. The limiting panel 32 is detachably mounted on a sidewall of the staple magazine 52, extend upward to the muzzle 51 of the staple gun 50 to hold the operating cap 22 securely with the anti-slip arm 21.

Figure 5:
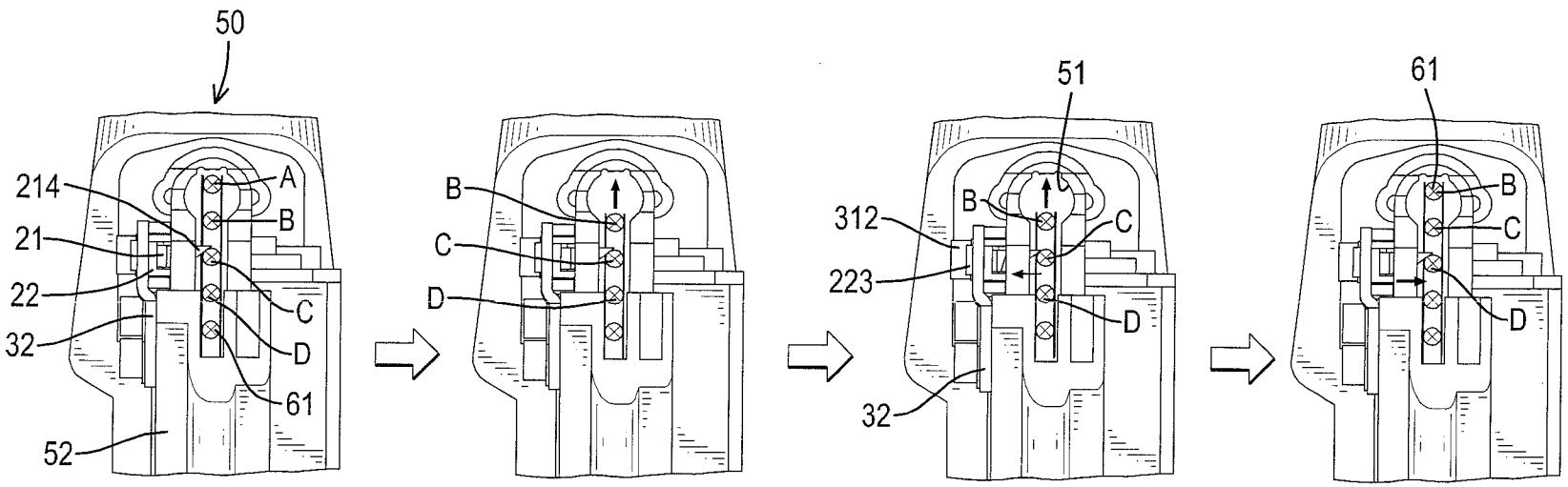
FIG. 5 is operational front views of the anti-slip assembly mounted in the staple gun in FIG. 1.

With reference to FIG. 3, when a staple gun 50 that has the anti-slip assembly in accordance with the present invention is in use, a staple row 60 composed of multiple staples 61 is mounted in the chamber of the staple magazine 52 and is moved upward by a pressing force of the pushing frame 53. Then, the uppermost staple 61 (A) is mounted in the muzzle 51 and aligns with a firing pin of the staple gun 50 as shown in FIG. 5.

Figure 4:
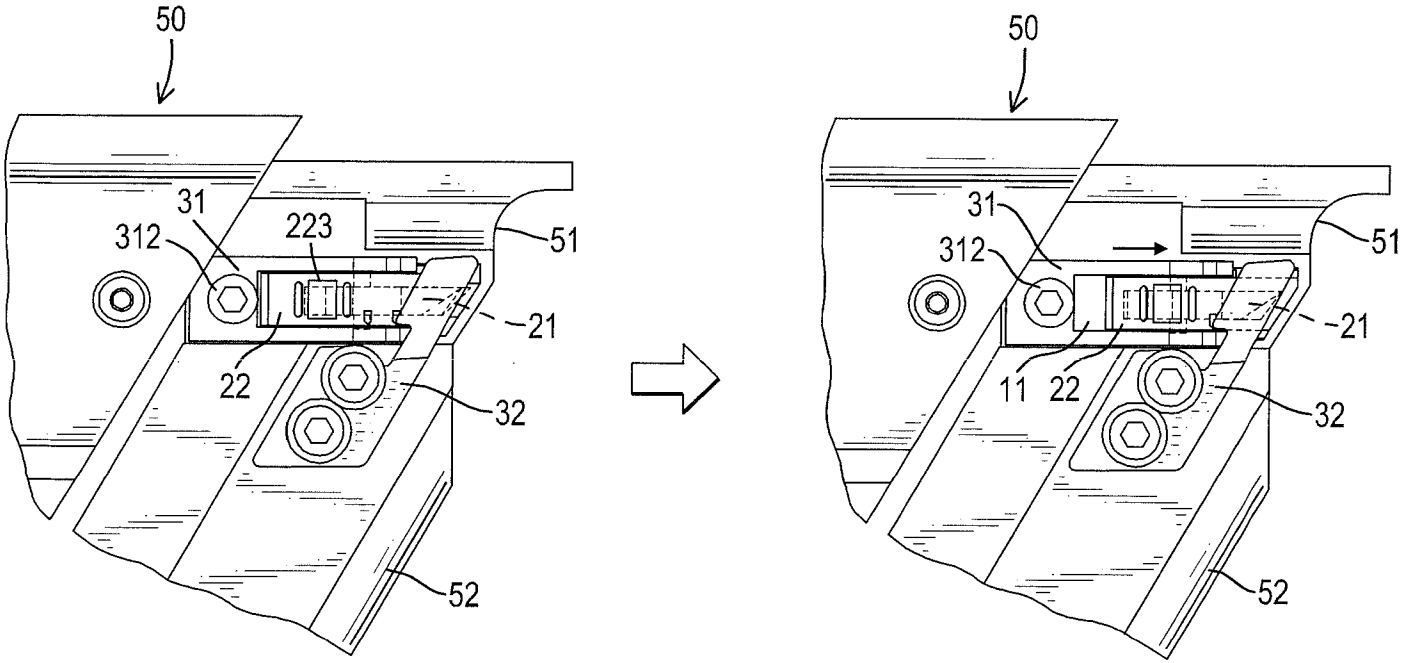
FIG. 4 is enlarged operational side views of the anti-slip assembly mounted in the staple gun in FIG. 1.

With reference to FIG. 4, the pushing protrusion 223 is pushed forwardly to enable the operating cap 22 to move forwardly along the mounting recess 11 relative to the anti-slip arm 21. With further reference to FIG. 2, when the operating cap 22 is moved to the front end of the mounting recess 11, the releasing recess 221 will move forwardly close to the mounting rod 211 of the anti-slip arm 21 to enable the rear end of the anti-slip arm 21 move outwardly to the releasing recess 221 by the spring 212 due to that the depth of the releasing recess 221 is deeper than the depth of the pressing recess 222. Then, the anti-slip arm 21 will pivot relative to the mounting recess 11 at the pivotal rod 213 as a pivot to enable the abutting stem 214 formed on the front end of the anti-slip arm 21 to move into the muzzle 51 via the through hole 14 of the mounting device 10 below a second staple 61 of the staple row 60 as shown in FIG. 5 to abut a third staples 61 (C) of the staple row 60 in the muzzle 51.

When the uppermost staple 61 (A) is ejected out of the muzzle 51 by an impact force of the firing pin, the second staple 61 (B) will be moved downwardly relative to the muzzle 51 by the vibration force and the reacting force provided from the firing pin and the ejecting staple 61 (A). Because the abutting stem 214 of the anti-slip arm 21 extends into the muzzle 51, the second staple 61 (B) can be held on the original position and be prevented from moving downwardly relative to the muzzle 51. In addition, when the first staple 61 (A) is ejected out of the staple gun 50, the pushing force of the pushing frame 53 is larger than the holding force of the abutting stem 214 of the anti-slip arm 21. Consequently, the pushing frame 53 can push the staple row 60 to against the holding force of the abutting stem 214 and to pivot the anti-slip arm 21 relative to the mounting recess 11. Then, the abutting stem 214 is moved out of the muzzle 51 and the second staple 61 (B) can be moved upwardly to become the uppermost staple 61 (A) by the pushing force of the pushing frame 53.

After the second staple 61(B) moves upwardly to become the uppermost staple 61 (A) and aligns with the firing pin. The abutting stem 214 will moves into the muzzle 51 again and abuts a fourth staple 61 (D) by the spring 212 pushing the rear end of the anti-slip arm 21 to move in the releasing recess 221. Then, this also can prevent the third staple 61 (C) from moving downwardly relative to the muzzle 51 by the vibration force and the reacting force that provided from the firing pin and the ejecting staple 61 (B). Furthermore, when the operating cap 22 is moved backward to the original position, the pressing recess 222 of the operating cap 22 will move to and abut the rear end of the anti-slip arm 21 to press the spring 212. Then, this can enable the anti-slip arm 21 to rotate relative to the mounting recess 11 by using the pivotal rod 213 as a pivot to enable the abutting stem 214 that formed on the front end of the anti-slip arm 21 to move out of the muzzle 51 and separate from the staples 61 of the staple row 60 and this is convenient in use.

According to the above-mentioned operation, the user only needs to push the operating cap 22 moving relative to the mounting recess 11, the abutting stem 214 of the anti-slip arm 22 can be moved into or out of the muzzle 51 of the staple gun 50 to abut or separate from the staples 61 of the staple row 60 in the staple magazine 52. Then, this can provide a holding effect to the staples 61 conveniently and prevent the staples 61 from moving downwardly relative to the muzzle 51 when the uppermost staple 61 is ejected out of the staple gun 50. Therefore, the staples 61 can be held on the correct position and aligns with the firing pin and this can provide a preferred quality of construction to the staple gun 50.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An anti-slip assembly for a staple gun comprising a gun shaped body having a front end;

a bottom end;

a sidewall; and a muzzle formed in the front end of the gun shape body; and a staple magazine obliquely connected to top end and the bottom end of the gun shaped body and having a chamber; and a pushing frame slidably mounted in the chamber of the staple magazine;

a mounting device formed in the sidewall of the gun shaped body of the staple gun adjacent to the muzzle and having a mounting recess formed in the sidewall of the gun shaped body of the staple gun and having a bottom surface;

a front end; and a rear end;

a positioning recess formed in the bottom surface of the mounting recess near the rear end of the mounting recess and having a bottom surface;

a pivotal recess formed in the bottom surface of the mounting recess between the positioning recess and the front end of the mounting recess; and a through hole formed through the bottom surface of the mounting recess, formed through the sidewall of the gun shaped body of the staple gun to communicate with the muzzle of the staple gun;

an operating device movably connected to the mounting device and having an anti-slip arm rotatably mounted in the mounting recess of the mounting device and having a front end;

a middle;

a rear end;

an internal surface facing the mounting recess of the mounting device;

an external surface;

a mounting rod formed on and protruding from the internal surface of the anti-slip arm near the rear end of the anti-slip arm and facing the positioning recess of the mounting device;

a spring mounted around the mounting rod, mounted in the positioning recess and abutting the internal surface of the anti-slip arm and the bottom surface of the positioning recess;

a pivotal rod formed on and protruding from the internal surface of the anti-slip arm near the middle of the anti-slip arm and mounted in the pivotal recess of the mounting device; and an abutting stem formed on and protruding from the internal surface of the anti-slip arm at the front end of the anti-slip arm and extending through the through hole of the device to mount in the muzzle of the staple gun; and an operating cap movably mounted in the mounting recess of the mounting device, mounted around the anti-slip arm and having an open front side mounted around the front end of the anti-slip arm to enable the abutting stem of the anti-slip arm extending out of the operating cap via the open front side of the operating cap;

a closed rear side mounted around the rear end of the anti-slip arm;

an open inner side mounted around the middle of the anti-slip arm;

a closed outer side;

a releasing recess formed in the operating cap near the closed rear side of the operating cap, communicating with the open inner side of the operating cap, selectively mounted around the rear end of the anti-slip arm and having a depth;

a pressing recess formed in the operating cap, communicating with the releasing recess and the open inner side of the operating cap and selectively abutting the external surface of the anti-slip arm near the pivotal rod or the rear end of the anti-slip arm and having a depth shallower than the depth of the releasing recess;

a pushing protrusion formed on and protruding from the closed outer side of the operating cap near the closed rear side of the operating cap; and at least one holding flange formed around the open inner side of the operating cap and abutting the bottom surface of the mounting recess of the mounting device; and a limiting device detachably connected to mounting device, being adapted to connect the staple gun and having a limiting frame being adapted to mount securely on the sidewall of the body of the staple gun, securely connected to the mounting device and extending into the mounting recess of the mounting device and having two rear ends being adapted to abut on the sidewall of the body of the staple gun beside the mounting recess;

two front ends extending into the mounting recess beside the positioning recess;

a middle; and two holding tabs respectively formed on the front ends of the limiting frame and abutting the at least one flange of the operating cap to hold the operating cap slidably mounted in the mounting recess of the mounting device; and a limiting panel being adapted to detachably mount on a sidewall of the staple magazine to hold the operating cap securely with the anti-slip arm.

2. The anti-slip assembly for a staple gun as claimed in claim 1, wherein the mounting device has a mounting protrusion adapted to form on and protrude from the sidewall of the body of the staple gun adjacent to the rear end of the mounting recess; and the limiting frame is securely connected to the mounting protrusion and has a mounting hole formed through the middle of the limiting frame and aligning with the mounting protrusion; and a fastener mounted in the mounting hole of the limiting frame and screwed into the mounting protrusion to hold the limiting frame on the sidewall of the body of the staple gun.

3. The anti-slip assembly for a staple gun as claimed in claim 2, wherein the mounting recess is rectangular;

the pivotal recess is semi-cylindrical; and the limiting frame is U-shaped.

4. The anti-slip assembly for a staple gun as claimed in claim 1, wherein the mounting recess is rectangular;

the pivotal recess is semi-cylindrical; and the limiting frame is U-shaped.

* * * * *